US010040647B2

(12) United States Patent
Waragai et al.

(10) Patent No.: US 10,040,647 B2
(45) Date of Patent: Aug. 7, 2018

(54) PAPER FEEDING DEVICE AND IMAGE FORMING APPARATUS

(71) Applicants: Ryuhei Waragai, Kanagawa (JP); Toshiaki Takahashi, Tokyo (JP)

(72) Inventors: Ryuhei Waragai, Kanagawa (JP); Toshiaki Takahashi, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/989,930

(22) Filed: Jan. 7, 2016

(65) Prior Publication Data

US 2016/0214809 A1 Jul. 28, 2016

(30) Foreign Application Priority Data

Jan. 24, 2015 (JP) ..... 2015-011867

(51) Int. Cl.
*B65H 1/12* (2006.01)
*B65H 1/26* (2006.01)
*B65H 1/14* (2006.01)

(52) U.S. Cl.
CPC ..... *B65H 1/12* (2013.01); *B65H 1/14* (2013.01); *B65H 1/266* (2013.01); *B65H 2403/41* (2013.01); *B65H 2405/1117* (2013.01); *B65H 2405/31* (2013.01)

(58) Field of Classification Search
CPC ... B65H 1/08; B65H 1/12; B65H 1/14; B65H 2403/41; B65H 2405/1117; B65H 2405/31
See application file for complete search history.

(56) References Cited

U.S. PATENT DOCUMENTS 4,280,692 A * 7/1981 Hutchinson ..... B65H 1/04 271/127
6,953,190 B2 * 10/2005 Shin ..... B65H 1/12 271/157
8,061,708 B2 * 11/2011 Fujita ..... B65H 1/266 271/145
8,251,364 B2 * 8/2012 Morinaga ..... B65H 1/12 271/157
8,695,967 B2 * 4/2014 Fujita ..... B65H 1/266 271/126
9,233,807 B2 * 1/2016 Lo ..... B65H 1/04
2003/0201597 A1 * 10/2003 Koh ..... B65H 1/12 271/147

(Continued)

FOREIGN PATENT DOCUMENTS

JP 2000-007162 1/2000
JP 2001-010732 1/2001

(Continued)

*Primary Examiner* — Jeremy R Severson
(74) *Attorney, Agent, or Firm* — Harness, Dickey & Pierce, P.L.C.

(57) ABSTRACT

When a paper feeding ray is set, an arm of a one-armed pinion makes a contact with an abutting member formed in a main unit to which the paper feeding tray is attached. When the paper feeding tray is pushed in, the arm is pushed by the abutting member, the one-armed pinion rotates as the rack member moves, and the one-armed pinion moves in a direction into the paper feeding tray. When a spring is stretched, a bottom plate push-up member rotates up on its rotation center and rises by a predetermined angle to press a bundle of stacked paper sheets against a feed roller, so that the paper sheets can be fed.

22 Claims, 4 Drawing Sheets

(56) References Cited

U.S. PATENT DOCUMENTS

| | | | | |
|---|---|---|---|---|
| 2004/0188922 | A1 | 9/2004 | Takahashi et al. | |
| 2006/0232000 | A1 | 10/2006 | Takahashi et al. | |
| 2008/0111296 | A1 | 5/2008 | Takahashi | |
| 2011/0024978 | A1* | 2/2011 | Nishikata | B65H 1/12 271/264 |
| 2011/0140341 | A1* | 6/2011 | Nishikata | B65H 1/266 271/3.09 |
| 2013/0154184 | A1* | 6/2013 | Shin | B65H 1/266 271/267 |
| 2015/0076764 | A1* | 3/2015 | Chiba | B65H 1/12 271/253 |

FOREIGN PATENT DOCUMENTS

| | | |
|---|---|---|
| JP | 2004-091056 | 3/2004 |
| JP | 2005-255361 | 9/2005 |
| JP | 2006-001669 | 1/2006 |
| JP | 2007-022738 | 2/2007 |
| JP | 2007-030995 | 2/2007 |
| JP | 2011-131960 | 7/2011 |

* cited by examiner

PAPER FEEDING DEVICE AND IMAGE FORMING APPARATUS

CROSS-REFERENCE TO RELATED APPLICATION

The present application claims priority to and incorporates by reference the entire contents of Japanese Patent Application No. 2015-011867 filed in Japan on Jan. 24, 2015.

BACKGROUND OF THE INVENTION

1. Field of the Invention

The present invention relates generally to a paper feeding device including a bottom plate lifting mechanism without motor and an image forming apparatus including the paper feeding device.

2. Description of the Related Art

In a paper feeding device used for an image forming apparatus, when paper sheets are taken and fed one by one from a bundle of paper sheets stacked and placed on a bottom plate in a paper housing unit, it is necessary to press the bundle of paper sheets against a paper feeding roller that is provided above the paper sheets prior to paper feeding. For this reason, in general, a mechanism that lifts the bottom plate is provided in a sheet housing unit. A spring pressure system and a motor control system are known for bottom plate lifting systems using the mechanism that lifts the bottom plate.

In general, in the spring pressure system, a spring is stretched by manual attachment of a paper feeding tray, or a spring that is compressed in advance is released, to push up the bottom plate. The motor control system lifts the bottom plate by a motor force.

The conventional spring pressure system is mechanically simple and inexpensive but has a disadvantage that the force of attaching or detaching the paper feeding tray is heavy and thus the operability lowers, so that the user has to push down the bottom plate. In short, while the conventional spring pressure system achieves cost reduction because mechanoelectrical parts are not used to lift the bottom plate, the bottom plate cannot be lowered automatically. For this reason, the user has to push down the bottom plate manually.

On the other hand, because the motor control system is for lifting the bottom plate by motor force, the disadvantage of the spring pressure system described above is significantly recovered. However, there is a problem that the motor requires mechanoelectrical parts, such as an inversion prevention mechanism, a paper upper limit detection sensor, and a lift lever lower limit detection sensor, which increases the costs.

For the purpose of reducing the costs of a structure of a device that lifts a bottom plate, Japanese Laid-open Patent Publication No. 2011-131960 discloses a structure for transmitting a rotation force obtained from, for example, a main motor instead of a drive motor, such as a lifting motor, to a toothed gear to drive the toothed gear and for lifting a bottom plate by using a flapper solenoid. However, because mechanoelectrical parts are necessary, that is, mechanoelectrical parts cannot be excluded, the problem of cost increase cannot be solved.

Therefore, there is a need to provide a paper feeding device including a bottom plate lifting mechanism that enables cost reduction by excluding mechanoelectrical parts but without lowering the tray operability, and an image forming apparatus including the paper feeding device.

SUMMARY OF THE INVENTION

It is an object of the present invention to at least partially solve the problems in the conventional technology.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of the present invention will be described with reference to the accompanying drawings.

According to an embodiment in a system that lifts and lifts down a bottom plate, the bottom plate can be lifted and lifted down with an inexpensive structure not requiring any user's operation to lift and lift down the bottom plate and not requiring mechanoelectrical parts. In short, linear motion for setting a paper feeding tray in an apparatus main unit of an image forming apparatus is transmitted to a rack by using a one-armed pinion. A bottom plate push-up member that is positioned under the bottom plate is rotated via a spring to lift up the bottom plate. In this system, no mechanoelectrical parts are used to lift and lift down the bottom plate and thus minimal components are used, which enables cost reduction.

First Embodiment

An embodiment of the present invention includes: a push-up member that rotates and lifts a bottom plate; a rack member movable along a side surface of a bottom plate; a spring that is attached between a bottom plate push-up member and the rack member; and a one-armed pinion that rotates in association with the rack member and an engagement tray insertion/pulling-out member. The paper feeding tray is set in an apparatus main unit of an image forming apparatus, so that the tip of the arm of the one-armed pinion makes a contact with a protrusion of the apparatus main unit and accordingly the pinion rotates. The rack member accordingly moves to rotate the bottom plate push-up member via the spring, thereby lifting the bottom plate. Pulling out the paper feeding tray gradually lifts down the bottom plate. In this manner the bottom plate can be lifted and lifted down not depending on mechanoelectrical parts.

Characteristics of the embodiment will be described in detail below with reference to the accompanying drawings.

Figure 1:
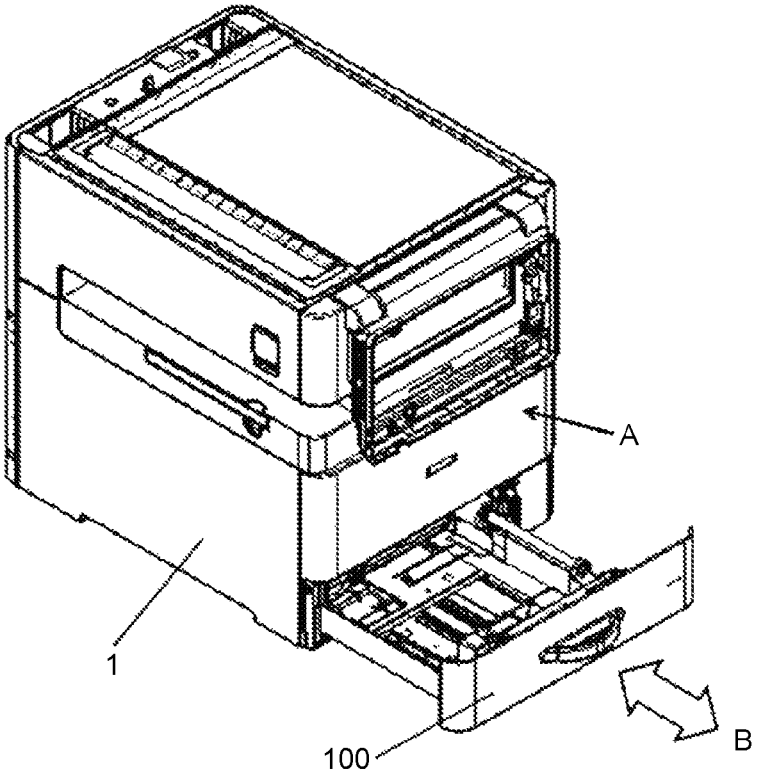
FIG. 1 is a perspective view showing an overview of a paper feeding device according to an embodiment of the present invention.

FIG. 1 shows an overview of a paper feeding device according to an embodiment of the present invention.

A paper feeding tray 100 serving as a paper housing member can be inserted into or pulled out of the front face A of an image forming apparatus main unit 1 (hereinafter, simply referred to as "the main unit 1") in the directions denoted by the arrow B shown in FIG. 1. Paper sheets are set in the paper feeding tray 100 and the paper feeding tray 100 is set in the main unit 1.

Figure 2:
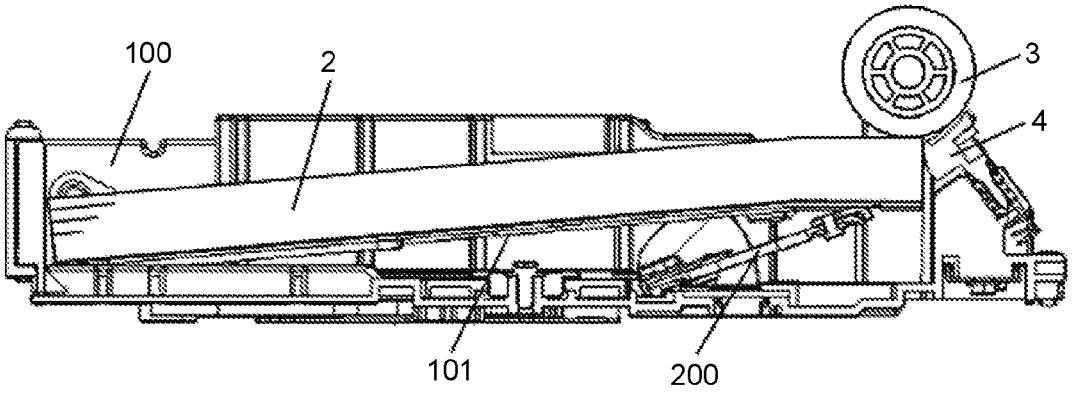
FIG. 2 is an enlarged cross-sectional view showing a separation transfer state in the paper feeding tray shown in FIG. 1.

FIG. 2 is an enlarged cross-sectional view showing a separation transfer state.

The reference numeral 3 denotes a feed roller that is fixed to an upper part of the paper feeding tray 100 on the side from which paper sheets are conveyed and that is pressed against the top paper sheet of the bundle of paper sheets 2 when paper sheets are fed. The reference numeral 4 denotes a friction pad for preventing paper sheets from being conveyed while overlapping. The friction pad 4 serves as a unit that presses the paper sheets against the feed roller 3 and that runs a bottom plate push-up member 200 to cause a bottom plate 101 to rotate.

Figure 3:
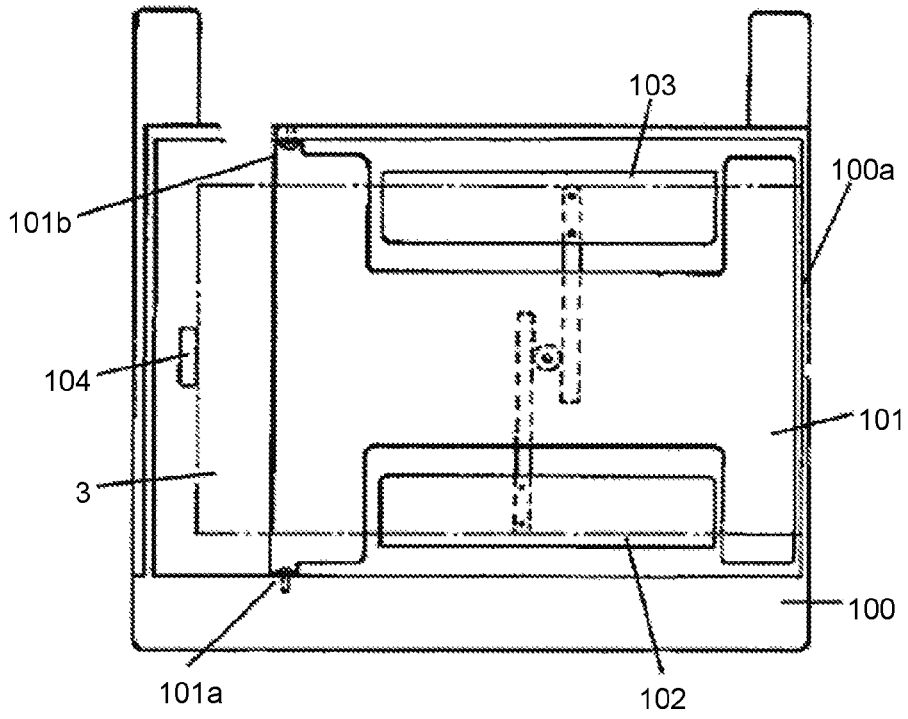
FIG. 3 is a plane view of the paper feeding tray shown in FIG. 2.

FIG. 3 is a plane view of the paper feeding tray 100. As shown in FIG. 3, the paper feeding tray 100 includes the bottom plate 101 that is turnably supported on ends 101*a* and 101*b* and on which paper sheets are stacked. The paper sheets can be positioned by a front wall 100*a*, a pair of side fences 102 and 103, and a back end fence 104 of the paper feeding tray 100.

Figure 4:
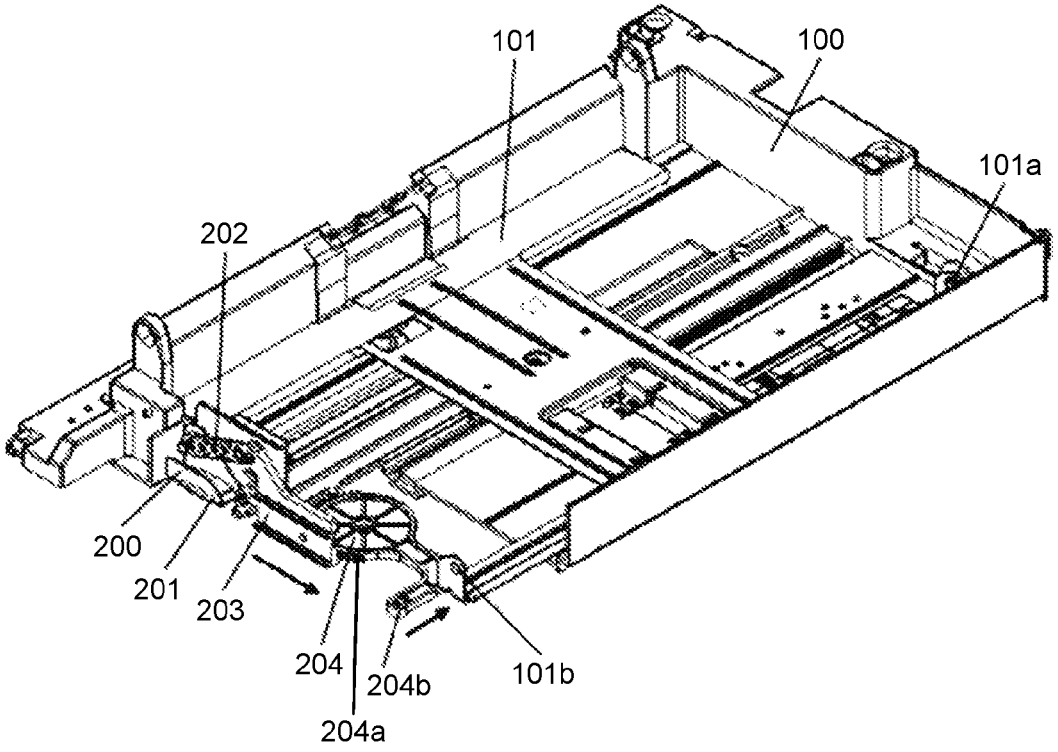
FIG. 4 is a perspective view showing the exterior of the paper feeding tray.
Figure 5A:
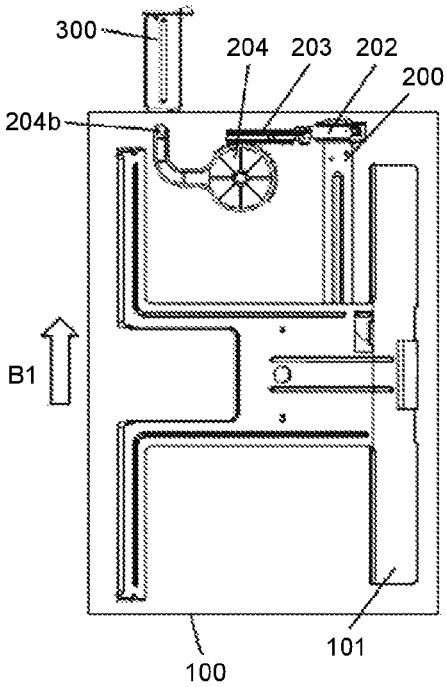
FIGS. 5A and 5B are diagrams for explaining operations according to the embodiment.
Figure 5B:
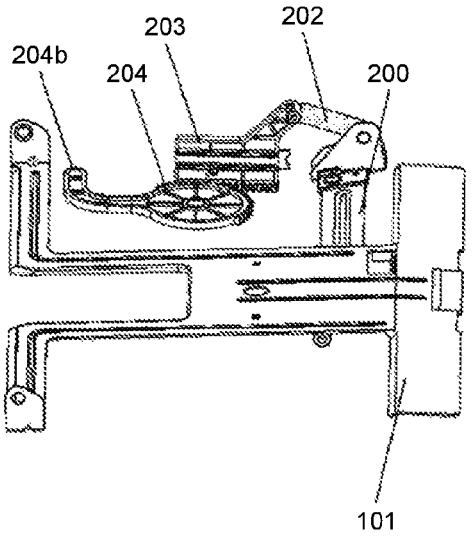

FIG. 4 is a perspective view showing the exterior of the paper feeding tray 100. With reference to FIG. 4, a mechanism for lifting the bottom plate 101 will be described.

The bottom plate 101 and the bottom plate push-up member 200 are attached to the paper feeding tray 100 and one end of a spring 202 is engaged with the bottom plate push-up member 200. The bottom plate 101 and the bottom plate push-up member 200 are rotatable on a rotation center 201 of the bottom plate push-up member 200. A rack member 203 is attached to the paper feeding tray 100 to be movable horizontally. The other end of the spring 202 whose one end is engaged with the bottom plate push-up member 200 is engaged with the rack member 203. The rack member 203 is positioned between the axis of rotation of the bottom plate 101 (the virtual axis along the line connecting the ends 101*a* and 101*b* in the embodiment) and the bottom plate push-up member 200 and is movable along the side surface of the bottom plate 101. The rack member 203 is engaged with the pinion gear unit 204*a* of a one-armed pinion 204 disposed on the back of the paper feeding tray 100. A part of the one-armed pinion 204, i.e., an arm 204*b*, moves in the directions in which the tray is inserted and pulled out, so that the one-armed pinion 204 rotates. Accordingly, the rack member 203 moves and thus the bottom plate push-up member 200 is rotated via the spring 202 and the bottom plate 101 also rotates accordingly.

FIGS. 5A, 5B, 6A and 6B are diagrams for explaining operations according to the first embodiment.

When the paper feeding tray 100 is set, the arm 204*b* of the one-armed pinion 204 makes a contact with an abutting member 300 formed in the main unit 1 to which the paper feeding tray 100 is attached. When the paper feeding tray 100 is inserted in the direction denoted by the arrow B1 shown in FIGS. 5A and 6A, the arm 204*b* is pushed by the abutting member 300. As the rack member 203 moves leftward in FIG. 6A, the one-armed pinion 204 rotates (in the direction denoted by R) and moves in the direction into the paper feeding tray 100 (the direction denoted by the arrow B2 in FIG. 6A). Specifically, the one-armed pinion 204 turns toward the center side of the bottom plate 101 under the bottom plate 101.

Figure 6A:
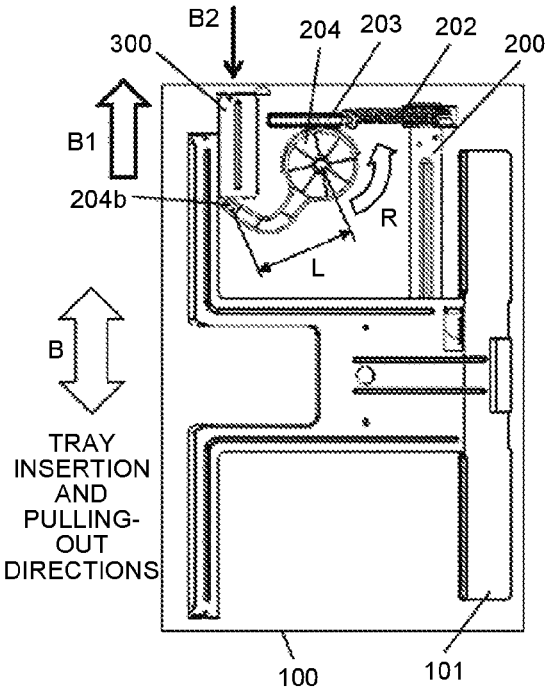
FIGS. 6A and 6B are diagrams for explaining operations according to the embodiment.
Figure 6B:
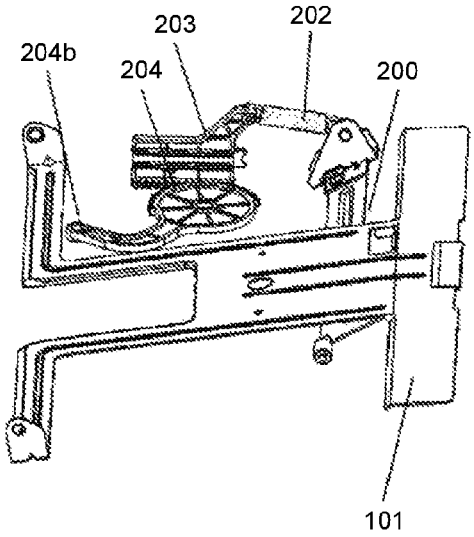

The spring 202 is then stretched rightward in FIGS. 6A and 6B and the bottom plate push-up member 200 rotates on the rotation center 201. The rotation direction is the rightward rotation direction according to FIG. 3 and the bottom plate push-up member 200 rotates up and rises by a predetermined angle to press the bundle of stacked paper sheets 2 against the feed roller 3. In this state, paper sheets can be fed. The pressure by which the bundle of paper sheets 2 is pressed against the feed roller 3 and the resulting paper feeding pressure can be controlled not only by changing the spring 202 but also by changing the position at which the rack member 203 and the one-armed pinion 204 are engaged with each other, which will be described below.

On the contrary, when the paper feeding tray 100 is pulled out, operations inverse to the above-described operations are carried out, so that the bottom plate 101 lifts down. As the paper feeding tray 100 is pulled out, the rack member 203 gradually moves and the bottom plate 101 accordingly lowers gradually. As a result, the sounds due to the operation can be reduced. The more the length of the arm 204*b*, i.e., the length L from the rotation center of the one-armed pinion 204, is increased, the more the moment force can be increased, which keeps the force of pushing the arm 204*b* necessary to achieve the paper feeding pressure within an appropriate range. For this reason, the force necessary to set the paper feeding tray 100 in the main unit 1 can be reduced. In short, by increasing the span between the pivot of the one-armed pinion 204 and the arm 204*b* to which the force is applied as much as possible, the force of lifting the bottom plate 101 can be minimized.

As described above, the arm 204*b* of the one-armed pinion 204 turns while making a contact with the abutting member 300 and has a shape such that only the tip of the arm 204*b* makes a contact with the abutting member 300. For example, when the arm 204*b* is L-shaped or has a shape similar to L as in the case of the embodiment illustrated in the drawings, only the tip of the arm 204*b* makes a contact with the abutting member 300 on the rotation path of the arm 204*b*. In other words, shaping the arm 204*b* to be L-shaped or to have a shape similar to L increases the span between the pivot of the one-armed pinion and the arm to which the force is applied. Even if this increases the rotation angle of the arm 204*b*, only the tip of the arm 204*b* makes a contact with the abutting member 300. This leads to an aimed paper feeding pressure and reduces the operation of the paper feeding tray 100.

Second Embodiment

Figure 7:
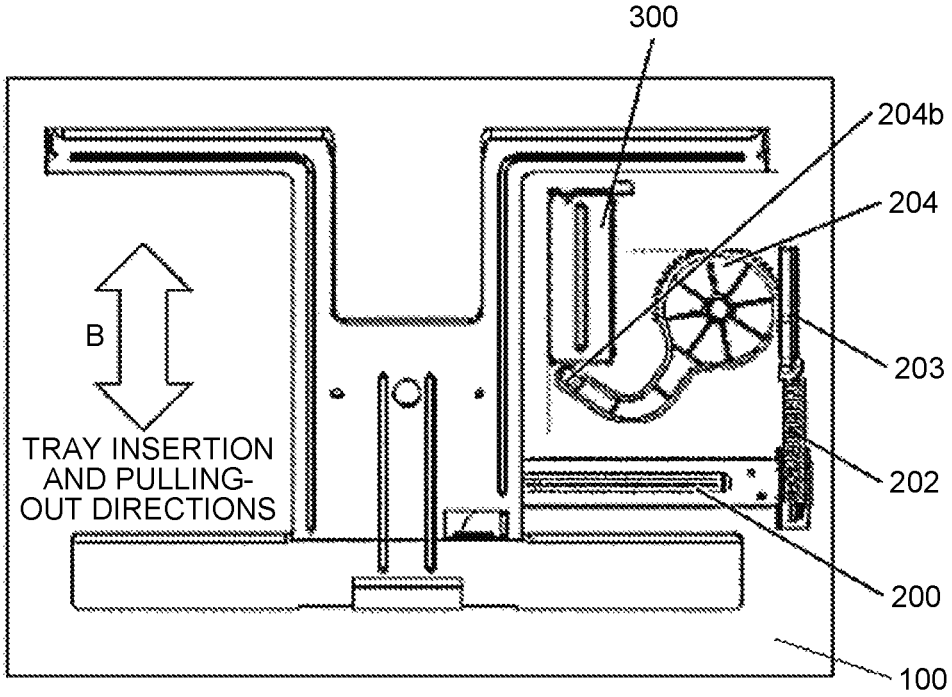
FIG. 7 is a diagram corresponding to FIG. 5A showing another embodiment of the present invention.

FIG. 7 is a diagram corresponding to FIG. 1A showing another embodiment of the present invention.

The second embodiment is different from the first embodiment in the directions in which the paper feeding tray 100 is inserted and pulled out but has a structure approximately the same as that of the first embodiment excluding that direction.

According to the second embodiment, the bottom plate 101 can be lifted and lifted down without requiring mechanoelectrical parts, particularly, a lifting motor, which minimizes the sound due to the operations of lifting and lifting down the bottom plate. Because neither a machine and nor a power for a machine is required to lift and lift down the bottom plate 101, the time during which the user waits, for example, from when the main unit 1 is powered on until the bottom plate 101 lifts to the position at which paper can be fed can be reduced. Although detailed graphical illustrations and explanations will be omitted, it is preferable that the paper feeding device has a function of taking paper sheets one by one with a unit that prevents paper sheets from transferred while overlapping.

According to the embodiment, it is possible to propose a bottom plate lifting mechanism that enables cost reduction by not using mechanoelectrical parts, a paper feeding device including the mechanism, and an image forming apparatus including the paper feeding device.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus including a paper housing member having a bottom plate on which paper sheets to be fed are stacked, the paper housing member comprising:

a bottom plate push-up member configured to lift the bottom plate;

a pinion including a pinion gear and an arm that protrudes from the pinion gear, the arm being configured to contact a main body of the image forming apparatus;

a rack member configured to engage the pinion gear; and a force exerting member configured to pull the rack member toward the bottom plate push-up member, wherein the arm is configured to be pushed by the main body while in contact with the main body and the pinion gear is configured to rotate together with the arm, to rotate the bottom plate push-up member when the paper housing member is inserted into the main body.

2. The image forming apparatus according to claim 1, the arm being configured to protrude from the pinion gear toward an abutting member in the image forming apparatus, wherein the arm has an L-shape or similar shape.

3. The image forming apparatus according to claim 2, wherein, the arm is configured to protrude from the pinion gear by a length such that, when the arm is configured to make contact with the abutting member, the arm is configured to make contact only with a tip of the abutting member.

4. The image forming apparatus according to claim 3, wherein, when the arm is configured to make contact with the abutting member, the arm is configured to turn toward a center side of the bottom plate.

5. The image forming apparatus according to claim 4, wherein the force exerting member includes a spring.

6. The image forming apparatus according to claim 5, wherein the image forming apparatus is configured to take the paper sheets one by one with a unit that prevents paper sheets from being conveyed while overlapping.

7. The image forming apparatus according to claim 5, wherein the image forming apparatus is configured to take the paper sheets one by one with a unit that prevents paper sheets from being conveyed while overlapping.

8. The image forming apparatus according to claim 4, wherein the force exerting member includes a spring.

9. The image forming apparatus according to claim 4, wherein the image forming apparatus is configured to take the paper sheets one by one with a unit that prevents paper sheets from being conveyed while overlapping.

10. The image forming apparatus according to claim 3, wherein, when the arm is configured to make contact with the abutting member, the arm is configured to turn toward a center side of the bottom plate.

11. The image forming apparatus according to claim 3, wherein, when the arm is configured to make contact with the abutting member, the arm is configured to turn toward a center side of the bottom plate.

12. The image forming apparatus according to claim 3, wherein the force exerting member includes a spring.

13. The image forming apparatus according to claim 3, wherein the image forming apparatus is configured to take the paper sheets one by one with a unit that prevents paper sheets from being conveyed while overlapping.

14. The image forming apparatus according to claim 2, wherein the force exerting member includes a spring.

15. The image forming apparatus according to claim 2, wherein the image forming apparatus is configured to take the paper sheets one by one with a unit that prevents paper sheets from being conveyed while overlapping.

16. The image forming apparatus according to claim 2, wherein, the arm is configured to protrude from the pinion gear by a length such that, when the arm is configured to make contact with an abutting member, the arm is configured to make contact only with a tip of the abutting member.

17. The image forming apparatus according to claim 2, wherein, when the arm is configured to make contact with an abutting member, the arm turns toward a center side of the bottom plate.

18. The image forming apparatus according to claim 1, wherein the force exerting member includes a spring.

19. The image forming apparatus according to claim 1, wherein the image forming apparatus is configured to take the paper sheets one by one with a unit that prevents paper sheets from being conveyed while overlapping.

20. The image forming apparatus according to claim 1, wherein the paper housing member is configured to be inserted into and pulled out of the main body of the image forming apparatus.

21. An image forming apparatus comprising:

a rotatable bottom plate;

a bottom plate push-up member coupled to the rotatable bottom plate;

a rack member coupled to the bottom plate push-up member;

a pinion including a pinion gear and an arm that protrudes from the pinion gear, the arm being configured to contact a main body of the image forming apparatus and the pinion gear being coupled to the rack member; and a feed roller, the rotatable bottom plate being biased towards the feed roller by the pinion and the rack member, and the arm being configured to be pushed by the main body while in contact with the main body and the pinion gear being configured to rotate together with the arm.

22. The image forming apparatus according to claim 21, wherein the main body includes an abutting member and the arm is configured to contact the abutting member.

* * * * *